US007357010B1

(12) United States Patent
Huang et al.

(10) Patent No.: US 7,357,010 B1
(45) Date of Patent: Apr. 15, 2008

(54) PLUG ASSEMBLY FOR A DOOR LOCK

(75) Inventors: Chao-Ming Huang, Kaohsiung Hsien (TW); Chi-Ming Chen, Kaohsiung Hsien (TW)

(73) Assignee: Taiwan Fu hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 11/602,226

(22) Filed: Nov. 21, 2006

(51) Int. Cl.
*E05B 17/04* (2006.01)

(52) U.S. Cl. ..... 70/379 R; 70/DIG. 42; 70/DIG. 62

(58) Field of Classification Search ..... 70/DIG. 42, 70/DIG. 62, DIG. 36, DIG. 61, 379 R, 379 A, 70/380, 372–375, 381, 370, 371, 466
See application file for complete search history.

(56) References Cited

U.S. PATENT DOCUMENTS 1,241,754 A * 10/1917 Molden ..... 70/81
2,001,329 A * 5/1935 Lyons et al. ..... 70/145
2,620,648 A * 12/1952 Quigley ..... 70/379 R
2,677,266 A * 5/1954 Hagstrom ..... 70/369
2,803,959 A * 8/1957 Schlage ..... 70/420
3,257,831 A * 6/1966 Schlage ..... 70/383
4,011,741 A * 3/1977 Nolin ..... 70/107
4,068,510 A * 1/1978 Neary ..... 70/379 R
4,228,669 A * 10/1980 Bischoff ..... 70/379 R
4,254,648 A * 3/1981 Dietrich ..... 70/380
4,358,943 A * 11/1982 Ouellet ..... 70/358
4,369,642 A * 1/1983 Grell ..... 70/389
4,403,485 A * 9/1983 Scherbing ..... 70/68
4,698,989 A * 10/1987 Zuckerman ..... 70/380
5,265,453 A * 11/1993 Konii et al. ..... 70/379 R
5,408,062 A * 4/1995 Agnatovech ..... 200/564
5,577,409 A * 11/1996 Oyabu et al. ..... 70/379 R
5,732,580 A * 3/1998 Garnault et al. ..... 70/422
5,907,963 A * 6/1999 Myers et al. ..... 70/371
2004/0255627 A1* 12/2004 Shimon ..... 70/379 R
2005/0097933 A1* 5/2005 Ruan ..... 70/493
2005/0199027 A1* 9/2005 Mannella ..... 70/379 R

* cited by examiner

*Primary Examiner*—Lloyd A. Gall
(74) *Attorney, Agent, or Firm*—Rosenberg, Klein & Lee

(57) ABSTRACT

A plug assembly has a cylindrical barrel portion, a plug, a driving shaft and a mounting cap. The cylindrical barrel portion has a rear end and a stop. The plug is mounted rotatably within the cylindrical barrel portion. The driving shaft is mounted securely on the rear end of the plug, rotates simultaneously with the plug and has a body. The body is attached to the rear end of the plug and has a non-circular cross section, a rear end and a driving hole defined coaxially in the rear end of the body of the driving shaft. The mounting cap is mounted around the driving shaft and has a front end and a limiting notch defined in the front end of the mounting cap. The stop on the cylindrical barrel portion is received in the limiting notch in the mounting cap.

10 Claims, 5 Drawing Sheets

PLUG ASSEMBLY FOR A DOOR LOCK

BACKGROUND OF THE INVENTION

1. Field of the Invention

The present invention relates to a door lock, and more particularly to a plug assembly for a door lock and having a positioning capability for against torsion.

2. Description of the Related Art

With reference to FIGS. 6 and 7, a conventional plug assembly (60) for a door lock comprises a cylindrical barrel portion (60), a plug (62), a driving shaft (63) and an adjusting cap (64). The plug (62) is mounted rotatably within the cylindrical barrel portion (60), extends out from the rear end of the cylindrical barrel portion (60) and is connected with the driving shaft (63) with the adjusting cap (64). The driving shaft (63) is connected to a driving blade in a doorknob.

However, because the conventional plug assembly (60) does not have any positioning and limiting structure, the plug (62) is easily overturned, and a large torsion will be applied to the driving blade to cause the driving blade being damaged. In addition, before the conventional plug assembly (60) is assembled to the doorknob, the plug (62) can be rotated freely relative to the cylindrical barrel portion (61). If the plug (62) is rotated at 180° when the plug assembly (60) is assembled onto the doorknob, as shown in FIG. 8, the plug (62) is in an incorrect assembling direction and cannot be rotated. Consequently, this will cause inconvenient of assembling the door lock.

SUMMARY OF THE INVENTION

The primary objective of the present invention is to provide a plug assembly for a door lock and having a positioning capability for against torsion.

The plug assembly in accordance with the present invention is mounted in a door lock and has a cylindrical barrel portion, a plug, a driving shaft, a mounting cap and an adjusting cap.

The cylindrical barrel portion has a rear end, a fin portion radially formed on and protruding from the cylindrical barrel portion and a stop formed on and extending longitudinally from the rear end of the cylindrical barrel portion.

The plug is mounted rotatably within the cylindrical barrel portion and has a rear end protruding out of the cylindrical barrel portion and a keyhole being defined axially through the plug. The plug further comprises a longitudinal hole defined in the rear end of the plug, a limiting spring and a limiting rod. The limiting spring is disposed in the longitudinal hole of the plug, and the limiting rod is disposed slidably in the longitudinal hole against the limiting spring.

The driving shaft is mounted securely on the rear end of the plug, rotates simultaneously with the plug and has a body being attached to the rear end of the plug. The body of the driving shaft has an outer surface, a non-circular cross section, a rear end, a driving hole defined coaxially in the rear end of the body of the driving shaft and a limit notch defined longitudinally in the outer surface of the body of the driving shaft. The limit notch is aligned with the longitudinal hole in the plug and receives the limiting rod.

The mounting cap mounted around the driving shaft and has a front end, a connecting hole and a reinforce side wall. The connecting hole corresponds to and engages with the body of the driving shaft. The reinforcing side wall is formed on and extends longitudinally from the front end of the mounting cap to define a limiting notch in the front end of the mounting cap and has two ends. The stop on the cylindrical barrel portion is received in the limiting notch in the mounting cap.

The adjusting cap is mounted around the rear end of the plug, is received in the mounting cap and has at least one limiting recess to hold the limiting rod inside.

The cylindrical barrel portion is mounted securely in the outer tube and has a rear end and a stop formed on and extending longitudinally from the rear end of the cylindrical barrel portion.

The plug is mounted rotatably within the cylindrical barrel portion and has a rear end protruding out of the cylindrical barrel portion and a keyhole being defined axially through the plug.

The driving shaft is mounted securely on the rear end of the plug, rotates simultaneously with the plug and has a body. The body is attached to the rear end of the plug and has an outer surface, a non-circular cross section, a rear end and a driving hole defined coaxially in the rear end of the body of the driving shaft.

The mounting cap is mounted around the driving shaft and has a front end and a limiting notch defined in the front end of the mounting cap and having two ends. The stop on the cylindrical barrel portion is received in the limiting notch in the mounting cap.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
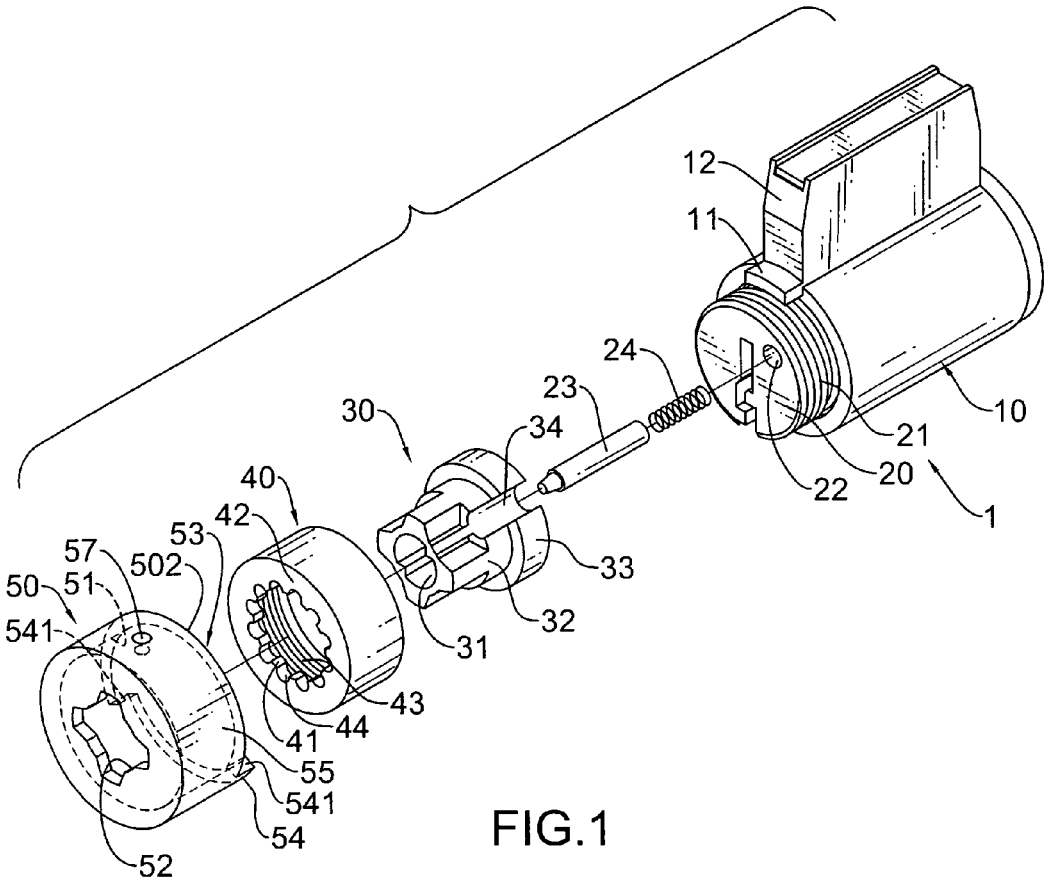
FIG. 1 is an exploded perspective view of a plug assembly in accordance with the present invention.

With reference to FIG. 1, a plug assembly for a door lock in accordance with the present invention comprises a housing (1), a driving shaft (30), an adjusting cap (40) and a mounting cap (50).

The housing comprises a cylindrical barrel portion (10) and a plug (20). The cylindrical barrel portion (10) is mounted securely in an outer tube in an outer doorknob of the door lock and has a front end, a rear end, a mounting hole and a stop (11). The mounting hole is defined longitudinally through the cylindrical barrel portion (10) and communicates with the front end and rear end of the cylindrical barrel portion (10). The stop (11) is formed on and extends longitudinally from the rear end of the cylindrical barrel portion (10). In addition, a fin portion (12) is radially formed on and protrudes from the cylindrical barrel portion (10) to hold a locking pin assembly therein. In addition, the stop (11) is aligned with the fin portion (12) and has a width substantially same as that of the fin portion and a thickness.

The plug (20) is mounted rotatably within the mounting hole in the cylindrical barrel portion (10) and has a rear end, a keyhole, a longitudinal hole (22), a limiting spring (24), a limiting rod (23) and an outer thread (21). The rear end has a cylindrical outer surface and protrudes out of the mounting hole in the cylindrical barrel portion (10). The keyhole is defined axially through the plug (20) to hold a corresponding key. The longitudinal hole (22) is defined in the rear end of the plug (20). The limiting spring (24) is disposed in the longitudinal hole (22) in the plug (20). The limiting rod (23) is disposed slidably in the longitudinal hole (22) against the limiting spring (24). The outer thread (21) is defined on the cylindrical outer surface of the rear end of the plug (20).

The driving shaft (30) is mounted securely on the rear end of the plug (20), rotates simultaneously with the plug (20), has a body (32), a flange (33), a driving hole (31) and a limit notch (34) and may be formed as an integral part of the plug (20).

The body (32) of the driving shaft (30) is cylindrical, is attached to the rear end of the plug (20), rotates when the plug (20) is rotated by a key and has an outer surface. The body (32) of the driving shaft (30) has a non-circular cross section, in preferable, the body (32) of the driving shaft (30) has a crisscross section.

The flange (33) is formed on and protrudes radially out from the outer surface of the body (32) of the driving shaft (30).

The driving hole (31) is defined coaxially in the rear end of the body (32) of the driving shaft (30), securely holds a driving blade and may be a blind hole to keep anyone from inserting a slender tool through the keyhole to break the driving blade.

The limit notch (34) is defined longitudinally in the outer surface of the body (32) of the driving shaft (30), is formed through the flange (33), is aligned with the longitudinal hole (22) in the plug (20) and receives the limiting rod (23) that rotates the driving shaft (30) simultaneously with the plug (20).

The adjusting cap (40) is hollow, is mounted around the cylindrical outer surface of the rear end of the plug (20) against the rear end of the cylindrical barrel portion (10), holds the driving shaft (30) and has a cylindrical circumferential wall, a rear surface (42), a central hole (41), an internal thread (43) and at least one limiting recess (44).

The cylindrical circumferential wall is provided with an inner surface defining a holding space for holding the driving shaft (30). The rear surface (42) is provided with the central hole (41) formed therethrough, in which the body (32) of the driving shaft (30) can extend therefrom.

The internal thread (43) is defined on the inner surface of the cylindrical circumferential wall of the adjusting cap (40) and screws onto the outer thread (21) of the plug (20).

The at least one limiting recess (44) is defined in an inner edge of the central hole (41) and aligns with the limit notch (34) in the driving shaft (30) to hold the limiting rod (23) in the longitudinal hole (22) to keep the adjusting cap (40) from turning relative to the plug (20). Thus, the adjusting cap (40) cannot be screwed off when the limiting rod (23) is in the at least one limiting recess (44).

Figure 2:
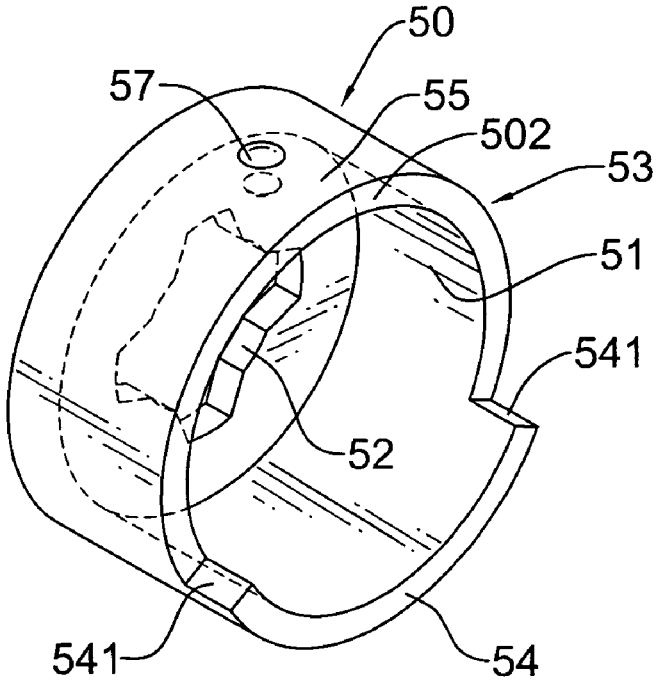
FIG. 2 is a perspective view of a first embodiment of the mounting cap of the plug assembly in FIG. 1.

With further reference to FIG. 2, the mounting cap (50) is hollow, is mounted around the adjusting cap (40) and rotates simultaneously with the driving shaft (30). The mounting cap (50) has a front end (502), a cylindrical circumferential wall, a rear surface, a connecting hole (52), a reinforcing side wall (54), a limiting notch (53) and a positioning mark (57).

The cylindrical circumferential wall is provided with an inner surface defining a holding space (51) for holding the adjusting cap (40). The rear surface is provided with the connecting hole (52) formed therethrough, in which the body (32) of the driving shaft (30) can extend therefrom. In addition, the connecting hole (52) has a cross section corresponding to that of the body (32) of the driving shaft (30) to make the mounting cap (50) rotating with the driving shaft (30).

The reinforcing side wall (54) is formed on and extends longitudinally from the front end (502) of the mounting cap (50) to define the limiting notch (53) in the front end (502) of the mounting cap (50) and has two ends (541). The reinforce side wall (54) has a thickness substantially same as that of the stop (11) to provide an enough structural strength, and the stop (11) is received in the limiting notch (53).

In a first embodiment, with reference to FIG. 2, the reinforcing side wall (54) is an integral curved tooth. In a second embodiment, with reference to FIG. 3, the reinforcing side wall (54') is composed of two teeth separated from each other and has an indentation (56) defined between the teeth of the reinforcing side wall (54').

The positioning mark (57) may be a knob, is formed on the cylindrical circumferential wall of the mounting cap (50) and corresponds to the limiting notch (53).

Figure 3:
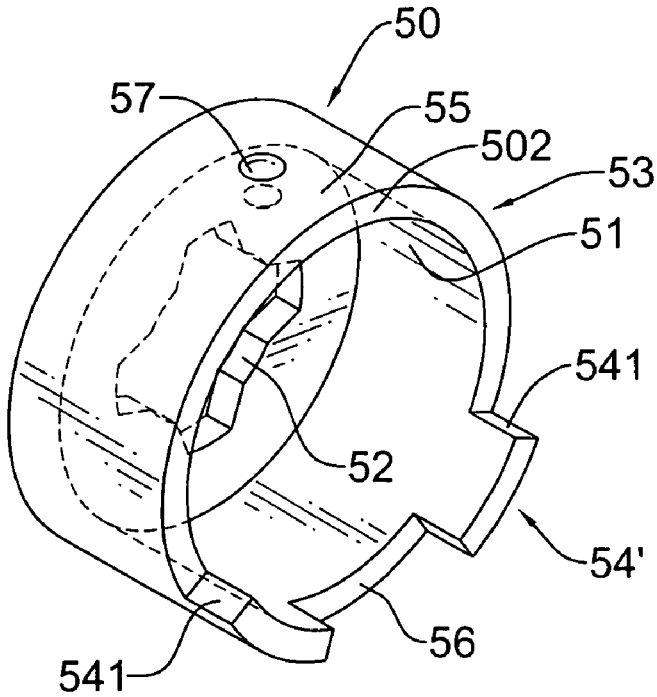
FIG. 3 is a perspective view of another embodiment of a mounting cap of a plug assembly in accordance with the present invention.
Figure 4:
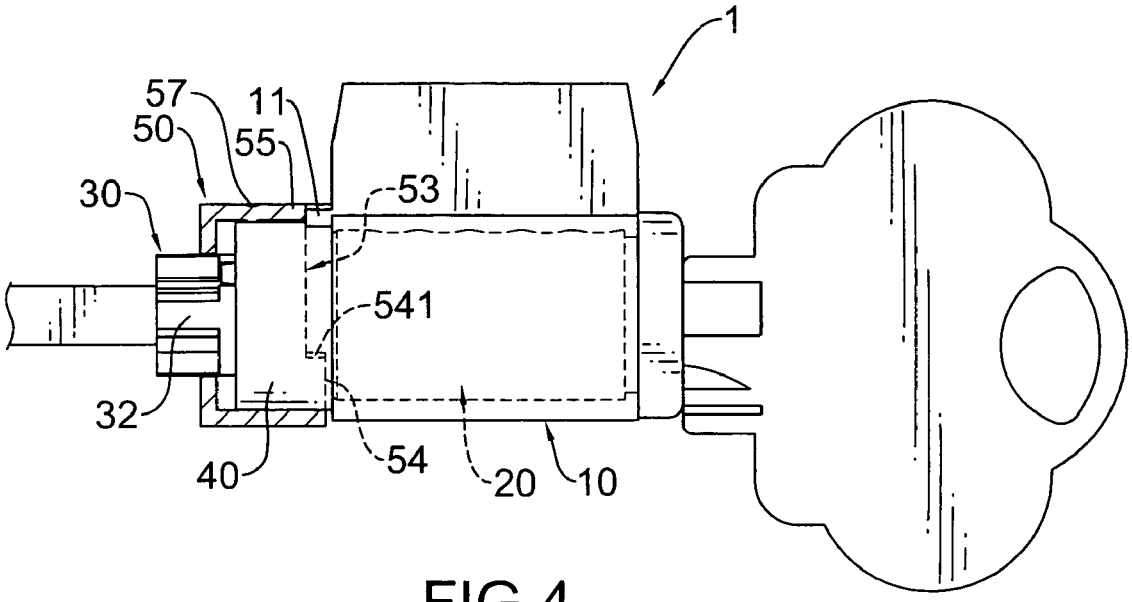
FIG. 4 is an operational side view of the plug assembly in FIG. 1 with a key being inserted into the plug assembly.
Figure 5:
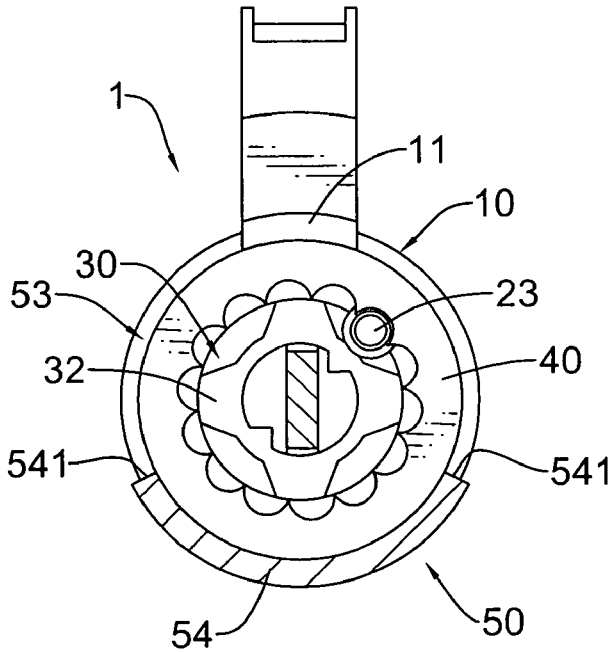
FIG. 5 is a rear view in partial section of the plug assembly with the key in FIG. 4.
Figure 6:
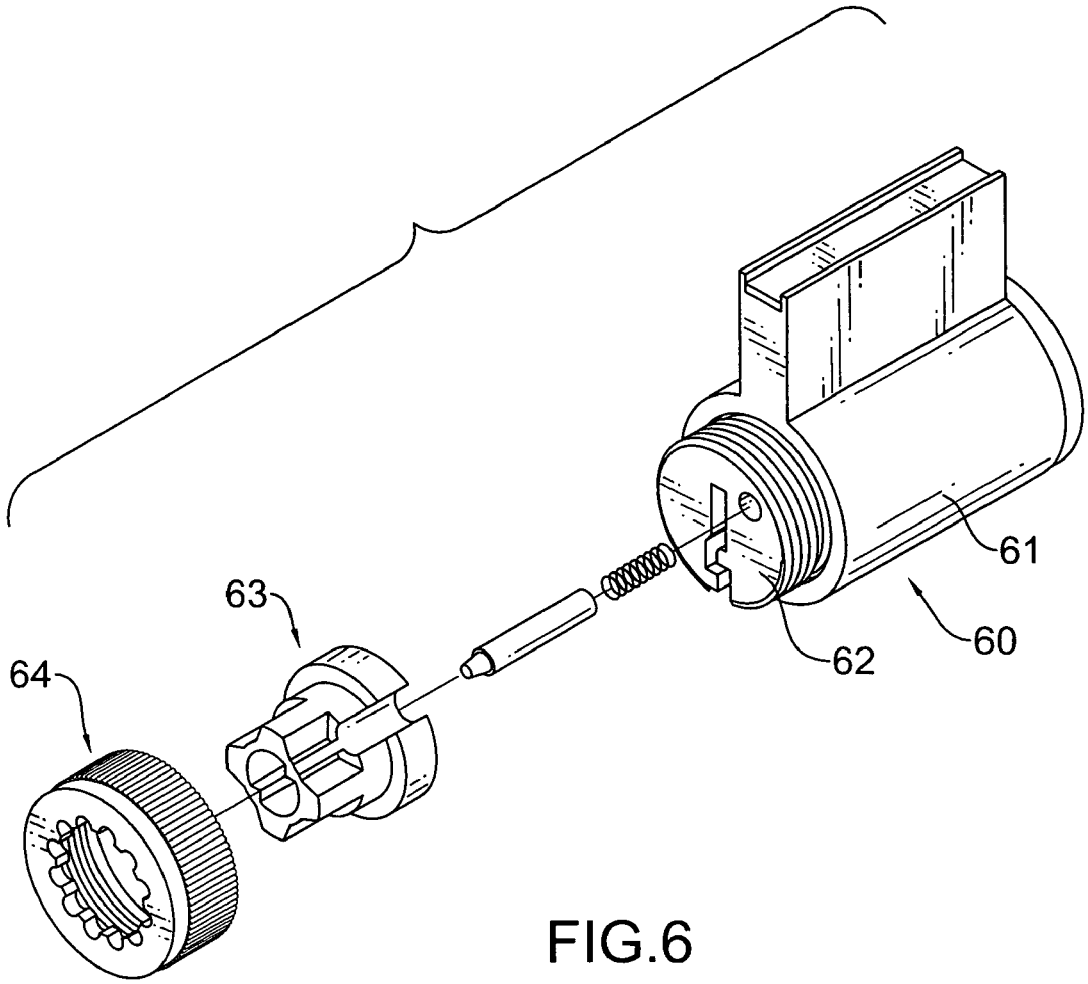
FIG.6 PRIOR ART
FIG. 6 is an exploded perspective view of a conventional plug assembly in accordance with the prior art.
Figure 7:
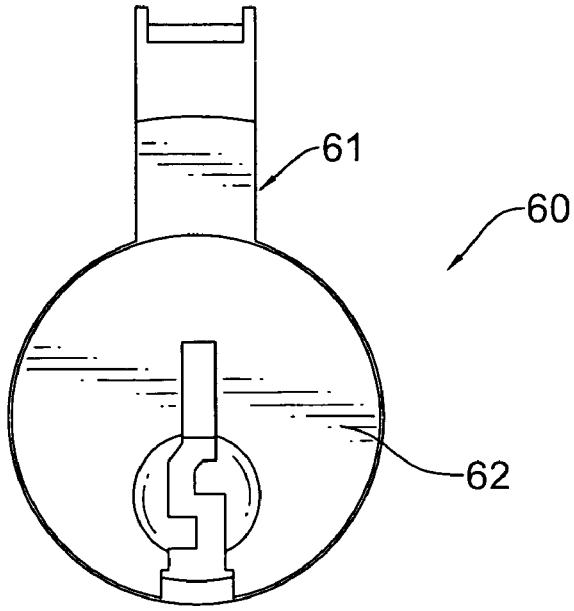
FIG.7 PRIOR ART
FIG. 7 is a front view of the conventional plug assembly in FIG. 6 showing that the plug is assembled at a correct position.
Figure 8:
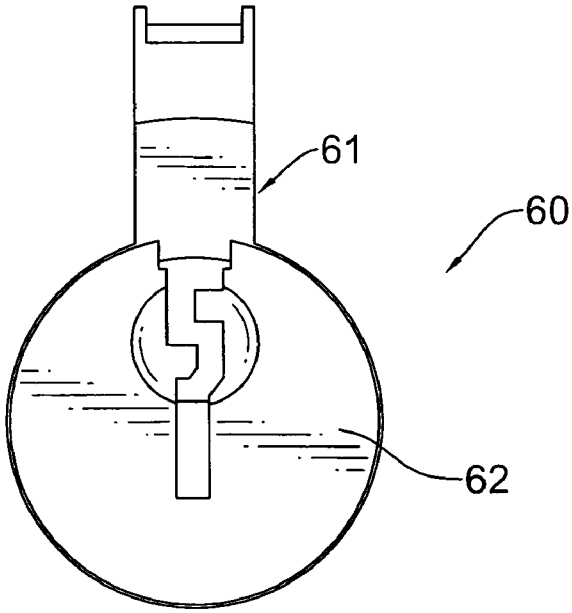
FIG.8 PRIOR ART
FIG. 8 is a front view of the conventional plug assembly in FIG. 6 showing that the plug is assembled at an incorrect position.

With reference to FIGS. 1, 3 and 4, with the arrangement of the mounting cap (50), the stop (11) on the cylindrical barrel portion (10) is received in the limiting notch (53) in the mounting cap (50). Consequently, the plug (20) can only be turned at a specific angular range with a specific key with the abutment between the stop (11) on the cylindrical barrel portion (10) and the ends (541) of the reinforced side wall (54) on the mounting cap (50). Accordingly, the plug will not be overturned to keep a large torsion from occurring, and the damage of the driving blade is prevented.

In addition, with the stop (11) being received inside the limiting notch (53) in the mounting cap (50), the rotation range of the plug (20) relative to the cylindrical barrel portion (10) is limited before the plug assembly is assembled to the doorknob. Accordingly, wrong assembling direction of the plug (20) is prevented.

Even though numerous characteristics and advantages of the present invention have been set forth in the foregoing description, together with details of the structure and features of the invention, the disclosure is illustrative only. Changes may be made in the details, especially in matters of shape, size and arrangement of parts within the principles of the invention to the full extent indicated by the broad general meaning of the terms in which the appended claims are expressed.

What is claimed is:

1. A plug assembly for a door lock comprising:

a cylindrical barrel portion having a rear end, a fin portion radially formed on and protruding from the cylindrical barrel portion and a stop formed on and extending longitudinally from the rear end of the cylindrical barrel portion;

a plug being mounted rotatably within the cylindrical barrel portion and having a rear end protruding out of the cylindrical barrel portion and a keyhole being defined axially through the plug, and the plug further comprising:

a longitudinal hole defined in the rear end of the plug;

a limiting spring disposed in the longitudinal hole of the plug; and a limiting rod disposed slidably in the longitudinal hole against the limiting spring;

a driving shaft being mounted securely on the rear end of the plug, rotating simultaneously with the plug and comprising a body being attached to the rear end of the plug and having an outer surface, a non-circular cross section, a rear end, a driving hole defined coaxially in the rear end of the body of the driving shaft and a limit notch defined longitudinally in the outer surface of the body of the driving shaft, aligned with the longitudinal hole in the plug and receiving the limiting rod;

a mounting cap mounted around the driving shaft and having a front end;

a connecting hole corresponding to and engaging with the body of the driving shaft; and a reinforcing side wall formed on and extending longitudinally from the front end of the mounting cap to define a limiting notch in the front end of the mounting cap and having two ends, wherein the stop on the cylindrical barrel portion is received in the limiting notch in the mounting cap; and an adjusting cap mounted around the rear end of the plug, received in the mounting cap and having at least one limiting recess to hold the limiting rod inside.

2. The plug assembly as claimed in claim 1, wherein the reinforcing side wall is composed of two teeth separated from each other and has an indentation defined between the teeth of the reinforcing side wall.

3. The plug assembly as claimed in claim 2, wherein the mounting cap has a cylindrical circumferential wall provided with an inner surface defining a holding space for holding the driving shaft and the adjusting cap; and a rear surface provided with the connecting hole formed therethrough, in which the rear end of the body of the driving shaft extends therefrom.

4. The plug assembly as claimed in claim 3, wherein the plug further has an outer thread defined on the rear end of the plug; and the adjusting cap has:

a cylindrical circumferential wall provided with an inner surface defining a holding space for holding the driving shaft;

a rear surface provided with a through hole formed therethrough, in which the rear end of the body of the driving shaft can extend therefrom; and an internal thread formed in the inner surface of the cylindrical circumferential wall of the adjusting cap and screwing onto the outer thread of the plug.

5. The plug assembly as claimed in claim 4, wherein the driving shaft further having a flange formed on and protruding radially out from the outer surface of the body of the driving shaft and being flush with the front end of the body; the limit notch is defined through the flange.

6. The plug assembly as claimed in claim 5, wherein the stop is aligned with the fin portion on the cylindrical barrel portion.

7. The plug assembly as claimed in claim 6, wherein the stop has a width same as that of the fin portion.

8. The plug assembly as claimed in claim 7, wherein the stop has a thickness same as that of the reinforcing side wall.

9. The plug assembly as claimed in claim 1, wherein the stop has a width same as that of the fin portion.

10. The plug assembly as claimed in claim 1, wherein the stop has a thickness same as that of the reinforcing side wall.

* * * * *